US005341602A

United States Patent [19]

Foley

[11] Patent Number: 5,341,602

[45] Date of Patent: Aug. 30, 1994

[54] APPARATUS FOR IMPROVED SLURRY POLISHING

[75] Inventor: Michael G. Foley, White Lake, Mich.

[73] Assignee: Williams International Corporation, Walled Lake, Mich.

[21] Appl. No.: 47,225

[22] Filed: Apr. 14, 1993

[51] Int. Cl.[5] ..... B24B 29/00; B24B 57/02

[52] U.S. Cl. ..... 51/2 R; 51/7; 51/317

[58] Field of Search ..... 51/7, 10, 410, 216 R, 51/217 R, 317, 319, 320, 321, 2 R; 15/268, 320

[56] References Cited

U.S. PATENT DOCUMENTS

| | | | |
|---|---|---|---|
| 3,634,973 | 1/1972 | McCarty | 51/2 R |
| 3,728,821 | 4/1973 | Perry | 51/2 R |
| 3,802,128 | 4/1974 | Minear, Jr. | 51/2 R |
| 3,883,997 | 5/1975 | Bulingame | 51/320 |
| 4,512,859 | 4/1985 | Inoue | 51/2 R |
| 4,706,414 | 11/1987 | Muzik | 51/7 |
| 4,773,244 | 9/1988 | Honda | 51/317 |
| 5,040,336 | 8/1991 | Ahern | 51/7 |
| 5,070,652 | 12/1991 | Rhoades | 51/7 |

OTHER PUBLICATIONS

Extrude Hone Sales Brochure/Literature.

General Electric T700 Blisk and Impeller Manufacturing Process Development Program, pp. 165–216.

*Primary Examiner*—Jack Lavinder
*Attorney, Agent, or Firm*—Layman R. Lyon

[57] ABSTRACT

A slurry polishing apparatus (100) comprises an assembly of an upper slurry input/output section (108), a polishing section (110), and a lower slurry input/output section (112). Each of the apparatus sections are individually detachable from the assembly to facilitate insertion and removal of a hydrodynamic or aerodynamic machine part having a complex surface shape such as a turbine fan (102). A plurality of upper slurry deflector blades (124) and lower slurry deflector blades (126) are removably attached to the polishing section (110), and positioned in the slurry flow path so as to direct the slurry mixture evenly over the entire surface of each respective fan blade (104), and corresponding exposed intermediary rotor surface (106). Because the high pressure slurry mixture flows evenly over the exposed fan surfaces, a consistent removal of metal stock is achieved across the entire polished surface. Thus, the need for additional slurry polishing and tedious hand blending to correct inconsistencies in the stock removal is dramatically reduced. Furthermore, a reduction in the amount of hand blending performed on the fan (102) proportionally decreases the likely occurrence of alpha case microfractures in the finished surface.

4 Claims, 2 Drawing Sheets

APPARATUS FOR IMPROVED SLURRY POLISHING

BACKGROUND OF THE INVENTION

The present invention relates generally to slurry polishing processes for finely polishing machined or cast metal parts, and more particularly to an apparatus which controls the slurry flow during the polishing process.

The machining or casting of mechanical parts typically creates surface asperities such as tool marks, cast lines, or overall surface roughness. Certain types of machined or cast parts, such as stators and rotors used in hydrodynamic or aerodynamic applications, usually require polishing to give smooth, even surfaces before the parts can be utilized. One known polishing process involves forcing a fluid containing an extremely abrasive grit to flow over the desired part surfaces to produce finely polished surfaces. This type of polishing process, commonly known as a slurry polishing process, entails adjusting the viscosity and the abrasive loading of the slurry (fluid) to control the amount of necessary metal removal for the desired surface finish.

A slurry polishing process generally provides sufficient results when applied to simple surface shapes. However, a part having complex surface shapes and passages is not particularly suited for conventional slurry polishing because the complex surface tends to cause a nonuniform slurry flow when polished. Consequently, the nonuniform slurry flow provides inconsistent metal stock removal, i.e., excessive stock removal in certain areas of the machined or cast part, and inadequate removal in other areas.

As a consequence, metal parts having a complex surface shape have generally been hand-blended (i.e., hand grinding or sanding). Particularly complex metal parts, such as turbine rotors, typically require many tedious hours of hand blending to achieve the desired surface finish. Further, microfractures, known as alpha case microfractures, are commonly encountered due to heat build-up on the machined or cast part during the hand blending process. Alpha case microfractures are highly undesirable because of the resulting metal fatigue incurred by the polished part.

SUMMARY OF THE INVENTION

It is therefore an object of the present invention to provide an apparatus which controls the slurry flow in a slurry polishing process to permit the slurry polishing of hydrodynamic or aerodynamic components formed from machined or cast parts having complex surface shapes.

It is also an object of the present invention to provide an improved slurry polishing apparatus which significantly reduces the amount of time required for completion of polishing process.

It is also an object of the present invention to provide an improved slurry polishing apparatus which allows even slurry flow over all surfaces without causing microfractures.

In accordance with the present invention, a slurry polishing apparatus comprises a first section having at least one opening to allow an abrasive slurry polishing mixture to flow through the apparatus, and a second section connected to the first section having a means for retaining a metal part relative to, and in contact with the slurry polishing mixture flow, and a means for evenly directing the slurry polishing mixture over a portion of the metal part surface designated for polishing. A third section having at least one opening is also connected to the second section to allow the slurry polishing mixture to flow through said apparatus. The means for evenly directing the slurry polishing mixture comprises a plurality of removable deflector blades respectively located between the openings of the first and third section and the metal part. Each of the plurality of deflector blades are contoured to deflect the flow of the slurry polishing mixture at an approximately uniform angle and flow rate relative to the designated surface of the metal part for which polishing is desired. Each of the plurality of removable deflector blades are preferably formed from a highly abrasion resistant material able to withstand prolonged contact with the slurry polishing mixture.

In further accordance with the present invention, the metal part comprises a hydrodynamic or aerodynamic component, such as a turbine fan, having a complex surface for which polishing is desired. The designated surface comprises a plurality of blades integrally formed with a rotor. Each of the plurality of deflector blades are contoured and dimensioned similar to the plurality of integrally formed blades to evenly deflect the slurry polishing mixture relative to the component to obtain an even removal of stock over the entire surface of each of the plurality of integrally formed blades and a portion of the rotor surface intermediate the respective plurality of integrally formed blades.

The present invention will be more fully understood upon reading the following detailed description of the preferred embodiment in conjunction with the accompanying drawings.

DETAILED DESCRIPTION OF THE PREFERRED EMBODIMENT OF THE INVENTION

Figure 1:
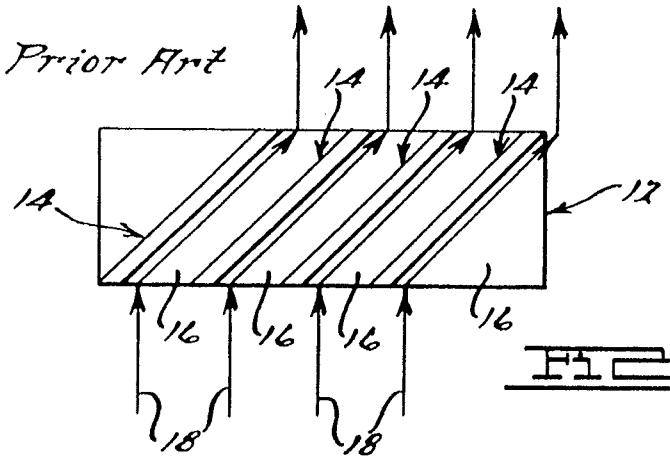
FIG. 1 representatively illustrates a conventional method of slurry polishing a metal part having a complex surface shape.

Referring to FIG. 1, there is shown an illustration representing a conventional slurry polishing process for a machined or cast metal part 12. Metal part 12 typically forms a stator or rotor used in hydrodynamic or aerodynamic applications, and is shown having an intricate, or complex, surface shape formed by protrusions 14 and passages 16 intermediate the protrusions 14. The metal part 12 is generally placed in a polishing apparatus, or fixture (not shown), which connects to a polishing machine (not shown). The polishing machine forces a slurry, i.e., a fluid comprising an extremely abrasive grit material, mixture 18 to flow over the surface of the machined part 12 (slurry flow indicated by arrows in FIG. 1) under high pressure.

As shown in FIG. 1, typical slurry polishing processes for metal parts having intricate surface shapes cannot provide an even slurry flow over the entire metal part surface. This drawback is particularly attributed to the slurry flow being controlled by the actual metal part surface. Uneven stock removal occurs because the slurry flow is contacting the surface at different angles and flow rates. For example, the slurry impacts directly upon the bottom portion of protrusions 14 where the surface shape of protrusions 14 cause the slurry to then flow parallel to the surface.

Figure 2:
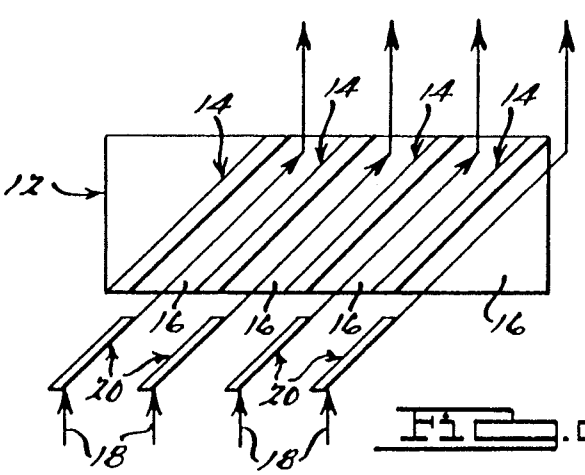
FIG. 2 representatively illustrates the slurry polishing of a metal part in accordance with the present invention.

Referring now to FIG. 2, there is shown an illustration representing an improved slurry polishing process for metal part 12 (shown in FIG. 1) in accordance with the present invention. A plurality of slurry deflectors 20 are contoured similar to protrusions 14 and positioned in the slurry flow path to evenly direct the slurry mixture 18 over the entire surface of metal part 12. The contouring of deflectors 20 to conform with the surface of metal part 12 allows the slurry 18 to flow at an approximately uniform angle and rate relative to the designated polishing surface. Consequently, a uniform stock removal of metal part 12 is achieved, thereby significantly reducing the amount of polishing time required to obtain the desired surface finish.

Figure 3:
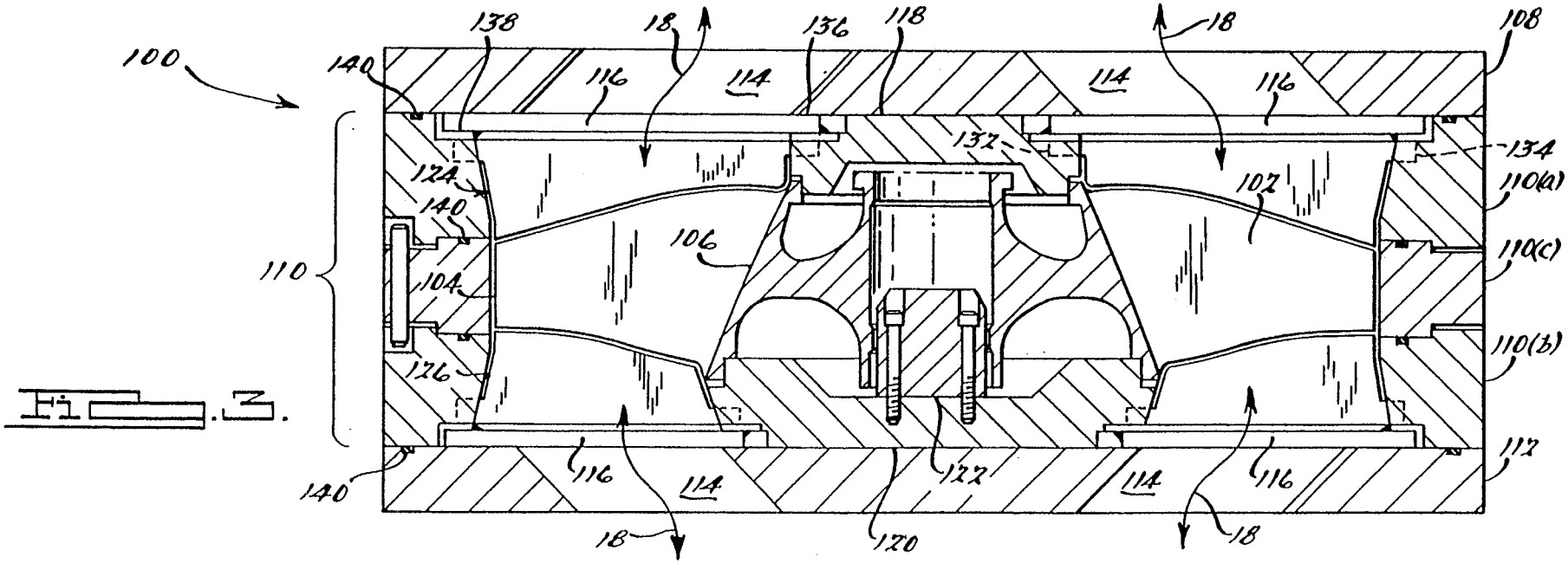
FIG. 3 is a cross section of a slurry polishing apparatus in accordance with the present invention.
Figure 4:
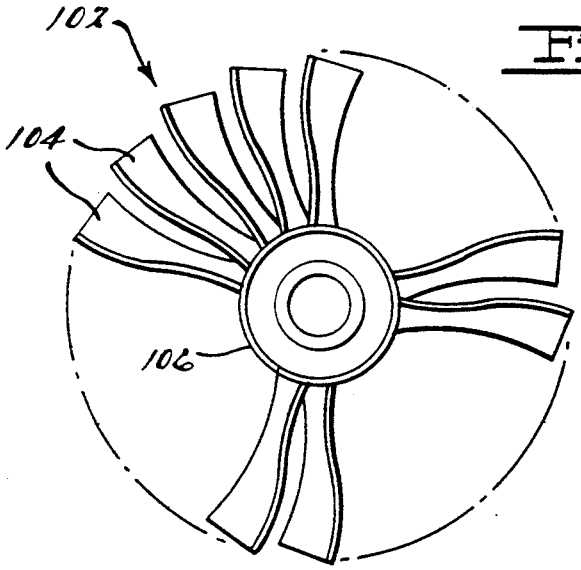
FIG. 4 illustrates a turbine fan suitable for slurry polishing in the apparatus of FIG. 3.
Figure 5:
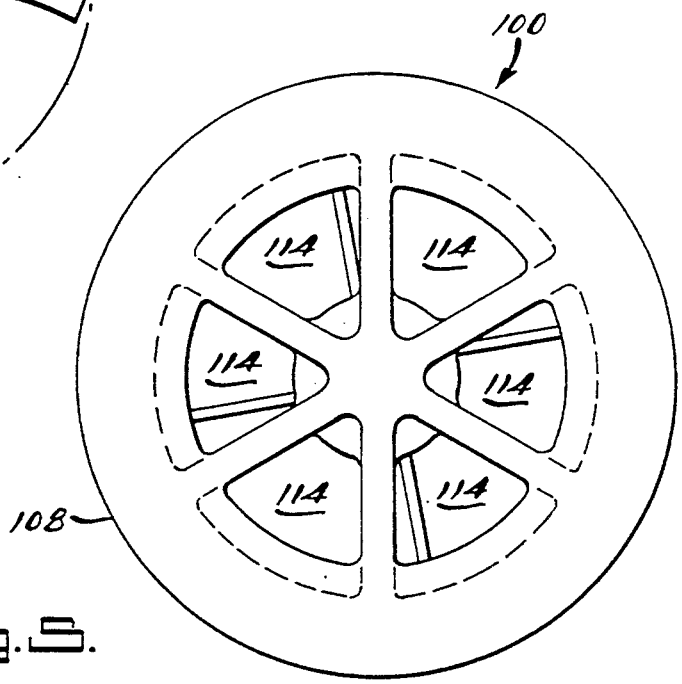
FIG. 5 is a top view of the slurry polishing apparatus of FIG. 3.
Figure 6:
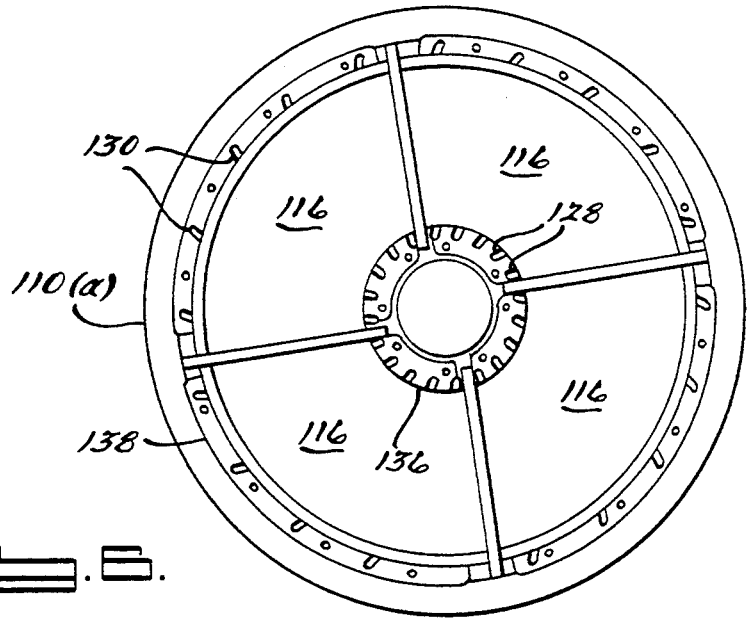
FIG. 6 is a top view of the slurry polishing apparatus of FIG. 3 with an upper slurry input/output section, turbine fan, and plurality of slurry deflector blades removed.

As shown in FIGS. 3, 5 and 6, a slurry polishing fixture 100, in accordance with the present invention, advantageously provides control of the slurry flow for polishing a hydrodynamic or aerodynamic component such as a turbine fan 102. As shown in FIG. 4, turbine fan 102 is formed having blades integrally cast or machined with the rotor. The turbine fan 102 comprises a plurality of blades 104 integrally cast, or machined, with a rotor 106, thus forming a hydrodynamic or aerodynamic metal part having an intricate, or complex, surface of separate arcuate protrusions orthogonally arranged around the circumference of the rotor surface 106. The turbine fan 102 can be cast, or machined, from a metal such as titanium.

In the past, the turbine fan 102 would typically require 40 to 60 hours of intense hand blending, i.e., hand sanding, to achieve a desired polished surface finish. However, the slurry polishing fixture 100 of the present invention eliminates, or significantly minimizes, the amount of hand blending required for an evenly polished surface finish, and the attendant risk of alpha case microfractures to the turbine fan 102 surface due to heat build up during the hand blending process.

The slurry polishing fixture 100 comprises an assembly of an upper slurry input/output section 108, a polishing section 110 arranged as three elements 110(*a*), 110(*b*), and 110(*c*), and a lower slurry input/output section 112. Each of the fixture sections are individually detachable from the assembly to facilitate insertion and removal of the fan 102. After insertion of the fan 102, and assembly of sections 108, 110, and 112, the fixture 100 is connected to a suitable slurry polishing machine (not shown) for initiation of the slurry polishing process.

The fixture sections 108 and 112 are provided with annular openings 114 which align with corresponding slurry conductors associated with the slurry polishing machine. In order to polish both sides of the fan 102, the slurry polishing machine delivers the slurry to sections 108 and 112 under high pressure in cycles having alternating slurry flow direction (as represented by arrows 18 in FIG. 3). Annular openings 114 deliver the slurry to annular openings 116 in polishing section 110 for subsequent application to the fan 102. Rotor hub seats 118 and 120, and center pin 122, properly position and retain the fan 102 within polishing section 110 during the polishing process.

In accordance with the present invention as described hereinabove with respect to FIG. 2, a plurality of upper slurry deflector blades 124 and lower slurry deflector blades 126 are removably attached to sections 110(*a*) and 110(*b*) and positioned in the slurry flow path so as to deflect the slurry mixture at an approximately uniform angle and flow rate, thereby directing the slurry mixture evenly over the entire surface of each respective fan blade 104, and corresponding exposed intermediary rotor surface 106. Because the high pressure slurry mixture flows evenly over the exposed fan surfaces, a consistent removal of metal stock is achieved across the entire polished surface. Thus, the total amount of polishing time required for achieving the desired surface finish is significantly reduced because the need for additional slurry polishing and tedious hand blending to correct inconsistencies in the stock removal is dramatically reduced. Furthermore, a reduction in the amount of hand blending performed on the fan 102 proportionally decreases the likely occurrence of alpha case microfractures in the finished surface.

As shown in FIG. 3, the plurality of upper slurry deflector blades 124 are contoured and dimensioned to approximate and conform with the contouring and dimensions of a front edge portion of each of the plurality of fan blades 104, and the lower slurry deflector blades 126 are contoured and dimensioned to approximate and conform with the contouring and dimensions of a back edge portion of each of the plurality of fan blades 104. In operation, the high pressure flow of abrasive slurry passes through annular openings 114 and 116 and impacts with either the plurality of upper slurry deflector blades 124 or bottom slurry deflector blades 126, depending on the current flow cycle of the polishing process. The respective plurality of deflector blades 124 and 126 bear the initial impact of the slurry flow, and because the deflectors conform with the surface of the fan blades 104, the subsequent deflection of the slurry mixture creates a nearly uniform angle and flow rate relative to the entire fan surface for which polishing is desired.

Because of the extreme abrasiveness of the slurry mixture, coupled with the deflector blades constantly enduring the initial impact of the slurry mixture, each of the deflector blades is highly susceptible to excessive wear. Therefore, each of the deflector blades can be constructed from a material sufficiently abrasion resistant to withstand numerous polishing cycles before requiring replacement. For example, the deflector blades can be formed from a metal such as titanium, and then subsequently coated with a highly abrasion resistant material such as plasma sprayed chromium carbide. Further, as best seen in FIG. 6, polishing sections 110(*a*) and 110(*c*) are provided with locating slots 128 and 130 for acceptance of respective extension tabs 132 and 134 (shown in dotted outline in FIG. 3) of the deflector blades 124 and 126. This arrangement facilitates easy installation and removal of the deflector blades into the fixture 100 to accommodate both the insertion and removal of the fan 102 from fixture 100, and the replacement of worn deflector blades. An inner and outer set of retainer rings 136 and 138 are bolted into sections 110(*a*) and 110(*b*) over the locating slots 128 and 130 to retain upper and lower deflector blades within the locating slots 128 and 130 upon the assembly of fixture 100. Further, a set of 0 rings 140 provide a seal between the respective fixture sections upon assembly.

It will be understood that the foregoing description of the preferred embodiment of the present invention is for illustrative purposes only, and that the various structural and operational features herein disclosed are susceptible to a number of modifications, none of which departs from the spirit and scope of the present invention as defined in the appended claims.

I claim:

1. A slurry polishing apparatus comprising:

a first section having at least one opening to allow an abrasive slurry polishing mixture to flow through said apparatus;

a second section connected to said first section having a means for retaining a metal part in contact with the slurry polishing mixture flow, and a means for evenly directing the slurry polishing mixture over a portion of the metal part surface designated for polishing; and a third section connected to said second section having at least one opening to allow the slurry polishing mixture to flow through said apparatus wherein said means for evenly directing the slurry polishing mixture comprises a plurality of removable deflector blades positioned between the metal part and the at least one opening in said first and third sections, each of said plurality of deflector blade being contoured to deflect the flow of the slurry polishing mixture at an approximately uniform angle and flow rate relative to the designated surface of the metal part for which polishing is desired.

2. The slurry polishing apparatus of claim 1 wherein each of said plurality of removable deflector blades are formed from a material sufficiently abrasion resistant to withstand prolonged contact with the slurry polishing mixture.

3. The slurry polishing apparatus of claim 1 wherein the metal part comprises a hydrodynamic or aerodynamic component comprising a plurality of blades integrally formed with a rotor, and each of said plurality of deflector blades are contoured and dimensioned similar to the plurality of integrally formed blades to evenly deflect the slurry polishing mixture relative to the metal part to obtain an even removal of stock over the entire surface of each of the plurality of integrally formed blades and intermediary rotor surface.

4. A slurry polishing apparatus comprising:

a first section having at least one opening to allow an abrasive slurry polishing mixture to flow through said apparatus;

a second section connected to said first section having a means for retaining a metal part in contact with the slurry polishing mixture flow, and a plurality of removable deflector blades positioned between the metal part and the slurry polishing mixture flow; and a third section connected to said second section having at least one opening to allow the slurry polishing mixture to flow through said apparatus, wherein each of said plurality of removable deflector blades are contoured and dimensioned to conform with the designated surface of the metal part for which polishing is desired to provide deflection of the slurry polishing mixture flow at an approximately uniform angle and flow rate relative to the designated surface of the metal part.

* * * * *